United States Patent [19]

Wasilewski

[11] Patent Number: 4,979,766

[45] Date of Patent: Dec. 25, 1990

[54] PANEL LATCH ASSEMBLY

[75] Inventor: Michael D. Wasilewski, La Habra, Calif.

[73] Assignee: The Hartwell Corporation, Placentia, Calif.

[21] Appl. No.: 303,843

[22] Filed: Jan. 30, 1989

[51] Int. Cl.[5] ..... E05C 9/10

[52] U.S. Cl. ..... 292/52

[58] Field of Search ..... 292/52, 18, 259, 216, 292/78, 79, 93, DIG. 31, DIG. 49

[56] References Cited

U.S. PATENT DOCUMENTS

| | | | |
|---|---|---|---|
| Re. 14,205 | 10/1916 | Young | 292/DIG. 71 X |
| 2,749,167 | 6/1956 | Love | 292/DIG. 31 X |
| 3,266,831 | 8/1966 | Banse | 292/235 X |
| 3,429,153 | 2/1969 | Magyar | 292/216 X |
| 3,578,368 | 5/1972 | Dupuis | 292/216 X |
| 4,291,631 | 9/1981 | Knippel | 292/216 X |
| 4,690,232 | 9/1987 | Schulz | 292/78 X |
| 4,784,414 | 11/1988 | Free | 292/52 |

*Primary Examiner*—Richard E. Moore

*Attorney, Agent, or Firm*—Lyon & Lyon

[57] ABSTRACT

A latch system for coupling a panel or access door to a structure, having a hook, a keeper, an overcenter mechanism and an actuator. When the hook engages the keeper, the keeper drives a ramp formed into the hook causing the hook to pivot. The hook, torsionally linked to the overcenter mechanism, activates the overcenter mechanism securing the hook in a closed position. When the actuator is depressed it reverses the overcenter mechanism pivoting the hook into an open position. Multiple hooks are shown associated with the latching assembly.

20 Claims, 2 Drawing Sheets

PANEL LATCH ASSEMBLY

BACKGROUND OF THE INVENTION

The field of the present invention relates to latches and latch systems.

Many latch systems are mounted to panels and doors in a manner such that some protruding handle or knob is required to open and close the latch. When such a panel or door doubles as a working surface or is used in a crowded area, such a protruding object can be hazardous or inconvenient.

In the aircraft industry when a panel or door is mounted to the exterior of an aircraft, any protruding object becomes aerodynamically undesirable, creating unnecessary drag. Thus, it is beneficial to provide a latch which can be mounted flush with the panel or door, and does not require an external handle. Additionally, the need for unique tools is bothersome; and the ability to operate a latch without a tool or removable handle is also desirable.

Another problem with many latch systems is that they can hold a panel or door in a semi-locked or closed but unlatched position. A door using such systems may appear locked when, in fact, the latch is only partially secured. Thus, it is advantageous in circumstances where complete closure is required that the panel or door not be capable of closure without latching fully.

Finally, the designs of many latch systems are not air and water tight. Such latches would be of little value on certain aircraft applications where a complete seal is required. Thus, latches which can be sealed against internal air pressure and external moisture are advantageous.

SUMMARY OF THE INVENTION

The present invention is directed to a latch system for joining two structures. A hook may be pivotally mounted in a first structure and arranged so as to engage a keeper mounted in a second structure to be joined with the first. When the two structures are appropriately positioned, the hook is intended to automatically engage the keeper, securing the two structures together. A retaining mechanism may be provided, incorporating an overcenter mechanism, to hold the hook biased in either the fully open or fully closed position. To actuate the hook, an actuation mechanism is contemplated.

The invention lends itself to latch designs preventing closure without latching. Also flush mounting may be achieved without the need for special tools. Sealing of the latch can also be achieved.

Accordingly, it is an object of the present invention to provide an approved flush latch system which has particular utility with aircraft panels, hatches and doors. Other and further objects and advantages will appear hereinafter.

DETAILED DESCRIPTION OF THE PREFERRED EMBODIMENT

Figure 1:
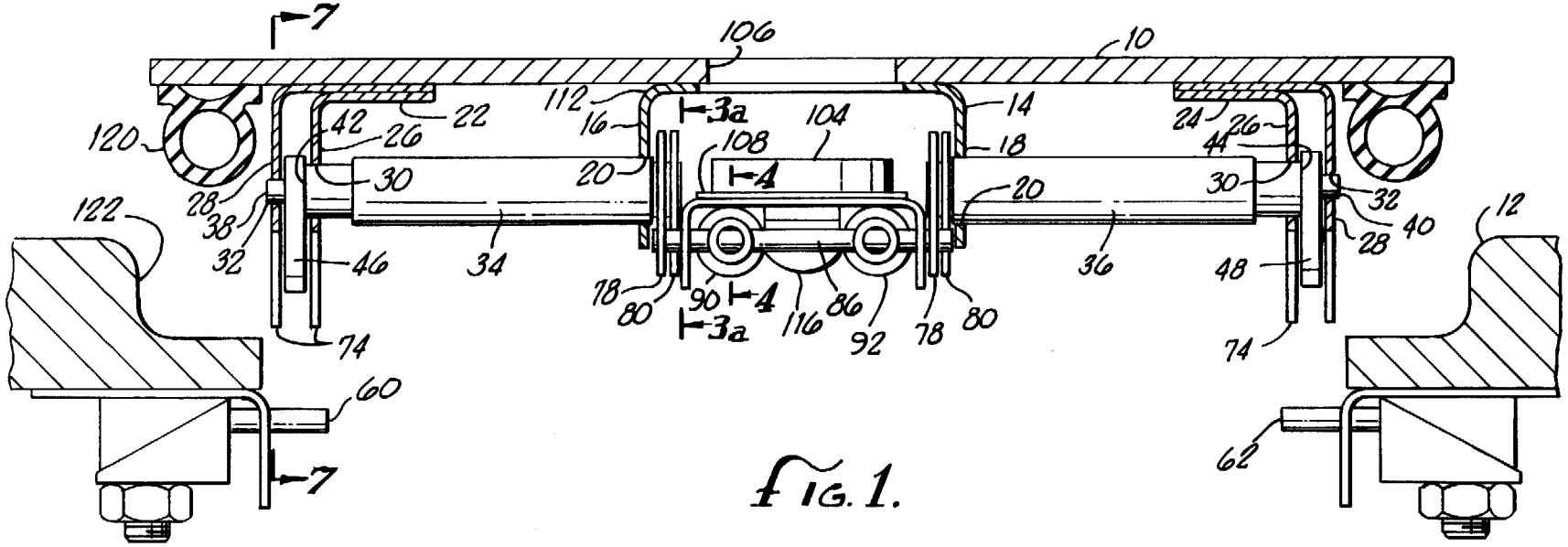
FIG. 1 is a front sectional view of the latch system on a panel in an open position arranged for association with a structure to which the panel may be assembled.

Turning in detail to the drawings, FIG. 1 illustrates a latch system which is intended to join a first structure 10, in this embodiment shown to be a panel, to a second structure 12, in this embodiment shown to be a body. The panel 10 and the body 12 are illustrated in an open position in FIG. 1 and in a closed position in FIG. 2. This particular embodiment of the latch system includes a pair of hooks. However, the panel 10 may be arranged such that one end is pivotally mounted to the body 12 in which case only one hook would be needed. The structures, therefore, may take various forms.

Fixed to the panel 10 are brackets for support of the latch system. A central bracket 14 is disposed centrally of the latching mechanism and includes a formed plate extending downwardly to form two support members 16 and 18. Each support member 16 and 18 includes a bearing aperture 20 which are preferably mutually aligned. Also fixed to the panel 10 are outer brackets 22 and 24. Each of the brackets 22 and 24 includes an inner guide plate 26 and an outer guide plate 28. The inner and outer guide plates 26 and 28 each include a bearing aperture 30 and 32, respectively. The several bearing apertures 20, 30 and 32 are all preferably aligned to define an axis.

Rotatably mounted in the bearing apertures are connecting shafts 34 and 36. The inner end of each of the shafts 36 and 38 is located in the bearing aperture 20 and rotatably mounted thereby. The outer end of each of the connecting shafts 34 and 36 extends through the inner and outer guide plates 26 and 28. The inner bearing aperture 30 is larger than the outer bearing aperture 32 to accommodate a change in shaft diameter. The connecting shafts 34 and 36 each have a reduced diameter end portion 38 and 40, respectively. This reduction defines a shoulder 42 and 44 of each connecting shaft 34 and 36 for mounting purposes.

Figure 6:
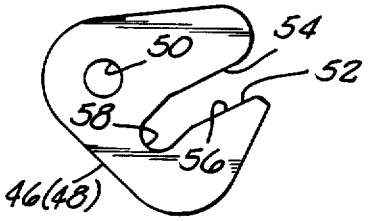
FIG. 6 is a plan view of the hook element.

The latch mechanism includes an identical pair of hooks 46 and 48. As best illustrated in FIG. 6, each of the hooks 46 and 48 is a solid, generally triangularly-shaped member provided with a mounting hole 50, a bite 52 and a drive ramp 54. The mounting hole 50 is located displaced from the bite 52 and serves to mount the hook to the associated linkage of the latch. The bite 52 is formed into the hook structure 46 and 48 is in the drive ramp 54. A channel 56 is formed between the bite 52 and the drive ramp 54 to accommodate and retain a keeper. A seat 58 is located at the inner end of the channel 56 where a keeper is retained when in the latched position. The drive ramp 54 begins at the seat 58 and extends outwardly, displaced from the bite 52.

The hooks 46 and 48 are fixed to the connecting shafts 34 and 36 by securing the hooks 46 and 48 at the mounting hole 50 to the reduced diameter end portions 38 and 40. The shoulders 42 and 44 provide a surface against which the hooks 46 and 48, respectively, may be located and fixed.

Located on the second structure or body 12 are keepers 60 and 62. The keepers 60 and 62 are positioned to engage the hooks 46 and 48, respectively. Each of the keepers 60 and 62 is defined by an adjustable block member 64 having a keeper pin 66 extending laterally therefrom. The block members 64 are retained by means of studs 68 and nuts 70. A guide plate 72 is also fixed to the body 12 associated with each keeper such that the keeper pin 66 extends generally along a normal to the guide plate 72.

Figure 7:
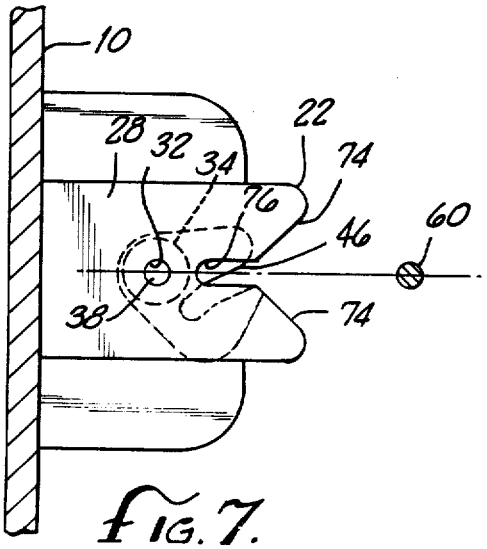
FIG. 7 illustrates the latch in an open position in relation to the guide bracket.
Figure 8:
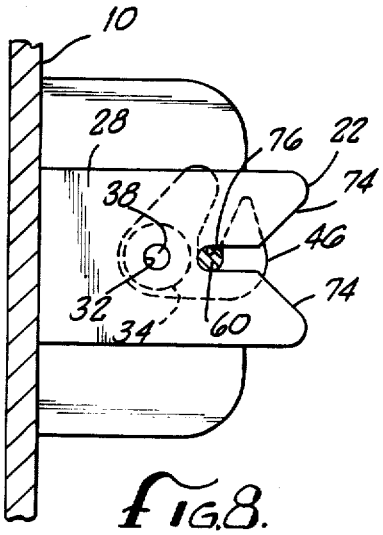
FIG. 8 is a detailed end view of the latch in a closed position securing a keeper.

Turning to FIGS. 7 and 8, the inner and outer guide plates 26 and 28 are shown to include converging guide ramps 74 and seats 76. The converging guide ramps 74 are designed to provide a wide entrance which tapers to the seat to insure that the keeper pins 66 may be easily positioned in the seats 76. The seats 76 are somewhat elongate with substantially parallel sides to eliminate relative lateral motion between the panel 10 and the body 12 through the seats 76 and guide pins 66. The guide plates 72 cooperate against the outer guide plates 28 to eliminate relative lateral motion perpendicular to that controlled by the seats 76. Each of the keeper pins 66 is of sufficient length to span across between the inner and outer guide plates 26 and 28 such that each keeper pin 66 is retained in two seats 76.

The hooks 46 and 48, each positioned between an inner guide plate 26 and an outer guide plate 28, are positioned to engage the keeper pins 66. Again, as best illustrated in FIGS. 7 and 8, the hooks 46 and 48 are mounted to the rotatable connecting shafts 34 and 36. With the hooks 46 and 48 rotated to an open position, the opening between the bite 52 and the drive ramp 54 aligns with the elongated seat 76. In this position, the drive ramp 54 extends diagonally across the open area of the seat 76 such that it interferes with the seating of the keeper pin 66. Thus, the panel 10 cannot be closed on the body 12 with the hooks 46 and 48 in the open position. As the panel is forced into the closed position, the keeper pins 66 ride against the drive ramp 54 and cause the hooks 46 and 48 to rotate. This rotation results in the hooks and keepers being arranged in the closed position as illustrated in FIG. 8. The closed position of the hooks 46 and 48 is such that the hook seat 58 presents a surface which is roughly perpendicular to the direction of extraction from the seat 76. The mounting hole 50 and the seat 58 of each of the hooks 46 and 48 are also arranged such that no opening moment is imposed on the hooks 46 and 48 when the panel 10 is forced outwardly away from the body 12. With this arrangement, the hook seat 58, the guide plate seat 76 and the guide plate 72 all cooperate to eliminate motion in any direction with the system in the latched position.

Figure 3A:
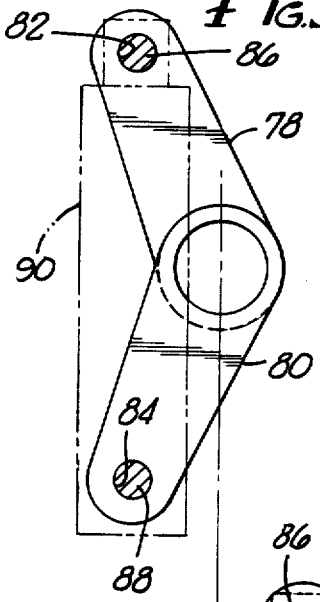
FIG. 3*a* is a transverse sectional view through 3*a*—3*a* of FIG. 1 illustrating the retaining mechanism in an open position.
Figure 3B:
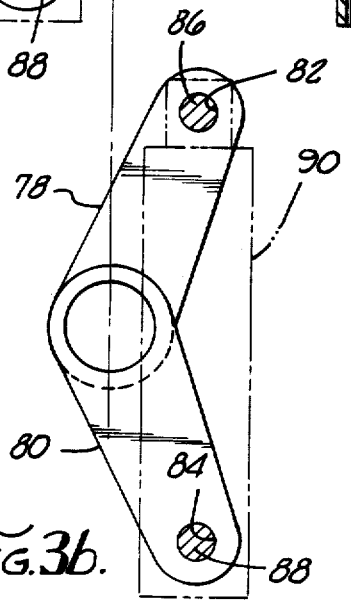
FIG. 3*b* is a transverse sectional view through line 3*b*—3*b* of FIG. 2 illustrating the retaining mechanism in a closed position.

An actuator mechanism is employed to control operation of the latch. The actuator mechanism is made up of an actuator assembly and an overcenter mechanism. The overcenter mechanism includes two overcenter linkages, each being associated with a connecting shaft 34 and 36. The overcenter linkage associated with the connecting shaft 34 is the same as the overcenter linkage associated with the connecting shaft 36. The linkage associated with the connecting shaft 34 includes a first arm 78 which is fixed to the connecting shaft 34 and extends laterally from the axis of the shaft. A second arm 80 is pivotally mounted on the connecting shaft 34 and also extends laterally from the axis of the shaft. The arms 78 and 80 are adjacent to one another and preferably spaced by a small amount so that there is no possibility of interference therebetween. Each of the arms 78 and 80 includes a mounting hole 82 and 84, respectively, adjacent the distal ends thereof. The arrangement of these arms 78 and 80 are best seen in FIG. 3*a* and FIG. 3*b*. Extending between mounting holes 82 on corresponding arms 78 on each overcenter linkage is a first rod 86. A second rod 88 is similarly positioned between mounting holes 84. The rods 86 and 88 may be fixed to the arms 78 and 80 such that the corresponding arms on the two overcenter linkages will operate together.

Figure 4:
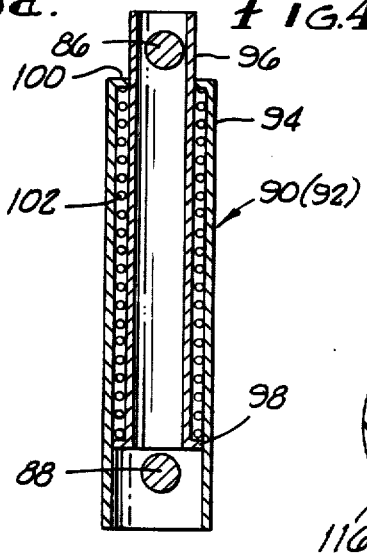
FIG. 4 is a transverse sectional view through line 4—4 of FIG. 1 illustrating the biasing mechanism.

Extending between the rods 86 and 88 are two spring assemblies 90 and 92. The spring assembly 90 is illustrated in cross section in FIG. 4 as comprising a spring cylinder mechanism including an outer cylinder 94 and a piston 96. The piston 96 includes an outwardly extending flange 98 while the cylinder 94 includes an inwardly extending flange 100. The piston 96 is shown to be coupled with the first rod 86 while the cylinder 94 is shown to be coupled with the second rod 88. Thus, as the rods 86 and 88 move apart, the flanges 98 and 100 move toward one another. A spring 102 is positioned between the flanges 98 and 100 and placed in compression therein. Thus, the spring 102 provides resistance to the rods 86 and 88 being drawn apart from one another. The spring biases the rods toward one another.

The overcenter links thus make up two systems for drawing the distal ends of the arms 78 and 80 toward one another. The mechanism illustrated in FIG. 3*a* and in FIG. 3*b* illustrates the open and closed positions of these links, respectively. To move from the open position to the closed position, the connecting shaft 34 is required to move upwardly to cross between the distal ends of the arms 78 and 80. This stretches the spring assemblies 90 and 92 creating an overcenter operation whereby once the connecting shaft 34 moves to either one side or the other of directly between the mounting holes 82 and 84, the device will either snap fully open or fully closed. As the connecting shaft 34 is fixed to the arm 78, this movement of the overcenter mechanism results in rotation of the hook 46 either to or from the latched position. The same result is achieved with regard to the hook 48.

Figure 5:
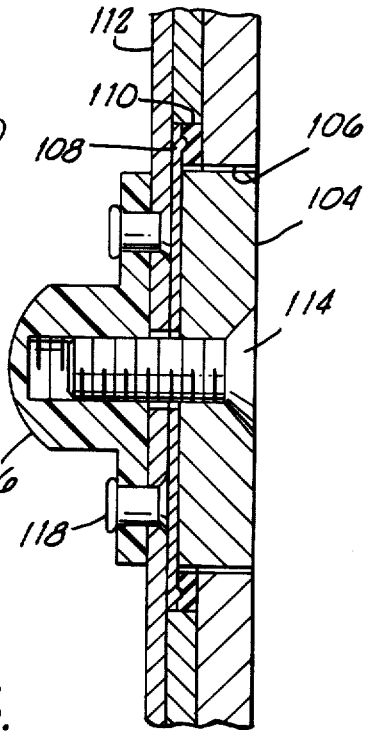
FIG. 5 is a transverse sectional view through line 5—5 of FIG. 2 illustrating the releasing mechanism.

The actuator mechanism also includes the actuator assembly comprising an actuator button 104. The button 104 is aligned with an access hole 106 in the panel 10. Preferably, the button 104 closely fits within the access hole 106 to avoid a substantial gap therebetween. The button 104 is shown in substantial detail in FIG. 5 as including a sealing flange 108 having a gasket 110. The gasket 110 thus is positioned completely around the button 104 to engage and form a seal with the panel 10 around the access hole 106. The button 104 also includes a bracket 112 fixed to the button 104 by means of a fastener 114 engaged with a nut 116, which in turn is fixed by rivets 118 to the bracket 112. The bracket 112 extends downwardly from the button to engage the rods 86 and 88. The rods are free to rotate in the bracket but are constrained to move downwardly when the button 104 is pushed inwardly from the panel 10.

Figure 2:
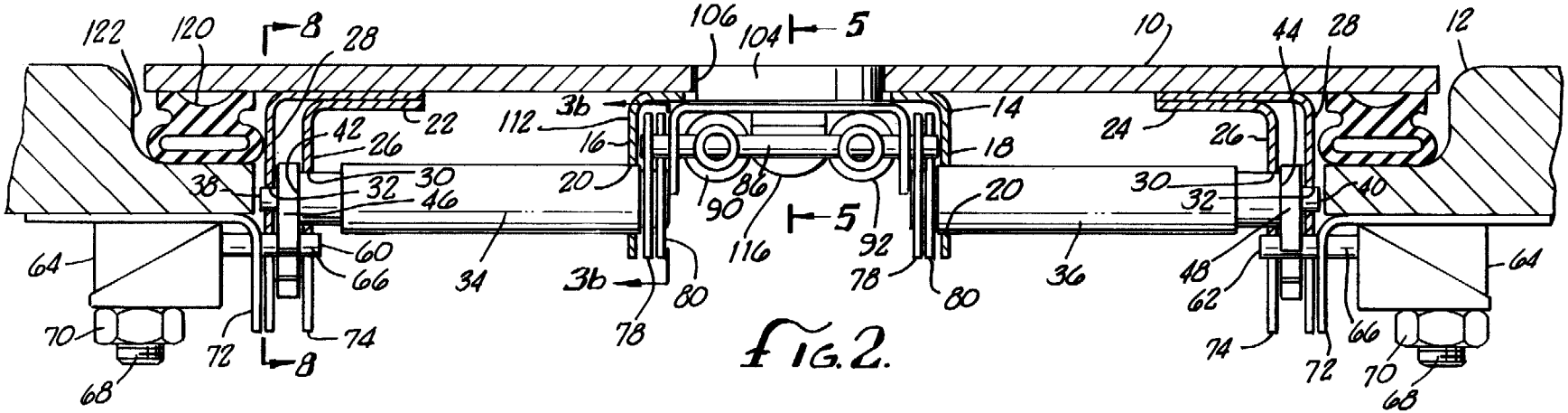
FIG. 2 is front sectional view of the latch system of FIG. 1 in a closed position.

The preferred embodiment illustrated includes a panel 10 which has a seal 120 about the periphery thereof. A well 122 is created in the body 12 to receive the seal 120 and panel 10 such that in the closed position the panel 10 is flush with the surface of the body 12, as seen in FIG. 2.

In operation, the panel 10 may be placed on the body 12 by first insuring that the button 104 is depressed. If the button 104 is not depressed, the hooks 46 and 48 will interfere with the keepers 60 and 62 such that the panel 10 cannot be placed in a flush position in the body 12. With the button depressed, the hooks are oriented as in FIG. 7 in preparation for receiving the keepers 60 and 62. As the panel 10 is forced into a flush position on the body 12, the keepers 60 and 62 engage the inner and outer guide plates 26 and 28. The conveying guide ramps 74 receive the keeper pins 66 forcing the panel 10 to be oriented such that the keeper pins 66 will engage the seats 76. As the panel 10 is forced into a flush position, the keeper pins 66 engage the drive ramps 54 and force the hooks 46 and 48 to rotate toward the latched position. As this occurs, the overcenter mechanism forces the spring assemblies 90 and 92 to extend until the overcenter mechanism passes through center. At this point, the spring assemblies 90 and 92 will act to draw the hooks 46 and 48 into the latched position as seen in FIG. 8. Thus, as the panel 10 is positioned, resistance to that positioning is first encountered and then the panel is forcefully drawn into the flush position. Removal of the panel requires actuation of the button 104 until the overcenter mechanism is again drawn through center. At this time, the mechanism aids in the opening process and withdraws the hooks 46 and 48 into the retracted or open position.

Thus, an improved flush latch system is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A latch system for coupling a pair of structures, comprising a hook pivotably mounted to a first structure of the pair of structures;

a keeper mounted to a second structure of the pair of structures, positioned to receive said hook with the structures joined;

an overcenter mechanism having first and second levers pivotably mounted to the first structure and coupled to pivot with said hook and an overcenter spring coupled to said lever and said second lever, said lever and said hook having a first, open position and a second, closed position, said overcenter spring being in greatest strain between said first and second positions of said lever and said hook; and an actuator coupled to said lever for pivoting said lever to said first position.

2. The latch system of claim 1 wherein said hook includes a drive ramp extending into interference with said keeper with said hook in the open position.

3. The latch system of claim 1 further comprising a guide plate mounted to the first structure, positioned to receive said keeper.

4. The latch system of claim 1 wherein said actuator further includes a seal fixedly mounted to said button, the first structure having a hole positioned to receive said button.

5. A latch system for coupling a pair of structures, comprising a pair of hooks pivotably mounted to a first structure of the pair of structures;

a pair of keepers mounted to a second structure of the pair of structures, wherein a first keeper of the pair of keepers and a second keeper of the pair of keepers is respectively positioned to receive a first hook of the pair of hooks and a second hook of the pair of hooks with the structures joined;

an overcenter mechanism having a first lever pivotably mounted to said first structure and coupled to pivot with said first and second hooks, an overcenter spring coupled to said lever and linked to said first structure, said lever and said first and second hooks having a first, open position and a second, closed position, said overcenter spring being in greatest strain between said first and second positions of said lever and said first and second hooks; and an actuator coupled to said lever for pivoting said lever to said first position.

6. The latch system of claim 5 wherein said overcenter mechanism has a second lever pivotably mounted to the first structure, said overcenter spring being coupled between said first and second levers.

7. The latch system of claim 5 wherein said hooks include drive ramps extending into interference with said keepers with said hooks in the open position.

8. The latch system of claim 5 further comprising a pair of guide plates mounted to the first structure and positioned to receive said pair of keepers.

9. The latch system of claim 5 wherein said actuator has a button pivotably coupled to said lever.

10 The latch system of claim 9 wherein the first structure has a hole positioned to receive said button, said actuator having a seal fixedly mounted to said button.

11. A latch system for coupling a pair of structures, comprising a hook pivotably mounted to a first structure of the pair of structures;

a keeper mounted to a second structure of the pair of structures, positioned to receive said hook with the structures joined;

an overcenter mechanism having a first lever pivotably mounted to the first structure and coupled to pivot with said hook, an overcenter spring coupled to said lever and linked to the first structure, said lever and said hook having a first, open position and a second, closed positioned, said overcenter spring being in greater strain between said first and said second positions of said lever and said hook;

a rotating member pivotably mounted to said first structure, said lever and said hook being fixedly mounted to said rotating member, said hook having a drive ramp extending into interference with said keeper with said hook in the open position; and an actuator coupled to said lever for pivoting said lever and said hook to said first position.

12. The latch system of claim 11 wherein said overcenter mechanism includes a second lever pivotably mounted to the rotating member, said overcenter spring being coupled between said first and second levers.

13. A latch system for coupling a pair of structures, comprising a hook pivotably mounted to a first structure of the pair of structures;

a keeper mounted to a second structure of the pair of structures, positioned to receive said hook with the structures joined;

a first guide plate fixedly mounted to the first structure and positioned to guide said hook into an interfering position with said keeper, said first guide plate being adjacent said hook and including a guide seat being sized to closely receive said keeper and converging guide ramps converging toward said seat; and an overcenter mechanism having a first lever pivotably mounted to the first structure and coupled to pivot with said hook and an overcenter spring coupled to said lever and linked to the first structure, said lever and said hook having a first, open position and a second, closed position, said overcenter spring being in greatest strain between said first and second positions of said lever and said hook.

14. The latch system of claim 13 wherein said hook includes a hook seat aligned with and extending across said guide seat when said hook is in said closed position to define a closed area between said hook and said first guide plate through which said keeper is sized to extend.

15. The latch system of claim 14 further comprising a second guide plate, said keeper extending along a normal to said second guide plate and said second guide plate being fixed to the second structure to abut said first guide plate with said hook engaging said keeper.

16. A latch system for coupling a pair of structures, comprising a hook pivotably mounted to a first structure of a pair of structures;

a keeper mounted to a second structure of the pair of structures, positioned to receive said hook with the structures joined;

a guide plate mounted to the first structure and positioned to guide said closure element into an engagement position with said keeper;

an overcenter mechanism having a first lever pivotably mounted to the first structure and coupled to pivot with said hook, and an overcenter spring coupled to said lever and linked to the first structure, said lever and said hook having a first, open position and a second, closed position, said overcenter spring being in greater strain between said first and second positions of said levers and said hook; and an actuator coupled to said lever for pivoting said lever to said first position.

17. A latch system for coupling a pair of structures, comprising a hook pivotably mounted to a first structure of the pair of structures;

a keeper mounted to a second structure of the pair of structures, positioned to receive said hook with the structures joined;

an overcenter mechanism having a first lever pivotably mounted to the first structure and coupled to pivot with said hook and an overcenter spring coupled to said lever and linked to the first structure, said lever and said hook having a first, open position and a second, closed position, said overcenter spring being in greatest strain between said first and second positions of said levers and said hook; and an actuator coupled to said lever for pivoting said lever to said first position, said actuator including a button pivotably coupled to said lever.

18. The latch system of claim 17 wherein said overcenter mechanism includes a second lever pivotably mounted to the first structure, said overcenter spring being coupled between said first and second levers.

19. The latch system of claim 17 wherein said hook includes a drive ramp extending into interference with said keeper with said hook in the open position.

20. The latch system of claim 17 further comprising a guide plate mounted to the first structure, positioned to receive said keeper.

* * * * *

UNITED STATES PATENT AND TRADEMARK OFFICE

CERTIFICATE OF CORRECTION

PATENT NO. : 4,979,766

DATED : December 25, 1990

INVENTOR(S) : WASILEWSKI

It is certified that error appears in the above-identified patent and that said Letters Patent is hereby corrected as shown below:

In claim 1 (col. 5, l. 48), after "said" (first occurrence), insert -- first --.

In claim 1 (col. 5, l. 49), delete "lever" and insert therefor -- levers --.

In claim 1 (col. 5, l. 52), delete "lever" and insert therefor -- levers --.

In claim 1 (col. 5, l. 53), delete "lever" and insert therefor -- levers --.

In claim 1 (col. 5, l. 54), delete "lever" and insert therefor -- levers --.

In claim 4, delete "1" and insert therefor -- 17 --.

UNITED STATES PATENT AND TRADEMARK OFFICE

CERTIFICATE OF CORRECTION

PATENT NO. : 4,979,766

DATED : December 25, 1990

INVENTOR(S) : WASILEWSKI

It is certified that error appears in the above-identified patent and that said Letters Patent is hereby corrected as shown below:

In claim 17 (col. 8, l. 24), delete "levers" and insert therefor -- lever --.

Signed and Sealed this

Fifth Day of January, 1993

*Attest:*

*Attesting Officer*

DOUGLAS B. COMER

*Acting Commissioner of Patents and Trademarks*